US011453929B2

(12) United States Patent
Okushiro et al.

(10) Patent No.: US 11,453,929 B2
(45) Date of Patent: Sep. 27, 2022

(54) COOLING DEVICE AND PRODUCTION METHOD FOR RAIL

(71) Applicant: JFE Steel Corporation, Tokyo (JP)

(72) Inventors: Kenji Okushiro, Tokyo (JP); Hideo Kijima, Tokyo (JP); Hiroshi Ishikawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 546 days.

(21) Appl. No.: 16/493,475

(22) PCT Filed: Mar. 14, 2018

(86) PCT No.: PCT/JP2018/010086
§ 371 (c)(1),
(2) Date: Sep. 12, 2019

(87) PCT Pub. No.: WO2018/168969
PCT Pub. Date: Sep. 20, 2018

(65) Prior Publication Data

US 2021/0348251 A1 Nov. 11, 2021

(30) Foreign Application Priority Data

Mar. 15, 2017 (JP) ..... JP2017-049871

(51) Int. Cl.
*C21D 11/00* (2006.01)
*C21D 9/04* (2006.01)
(Continued)

(52) U.S. Cl.
CPC ..... *C21D 11/005* (2013.01); *C21D 1/18* (2013.01); *C21D 6/002* (2013.01); *C21D 6/004* (2013.01);
(Continued)

(58) Field of Classification Search
CPC ..... C12D 11/005; C12D 9/0062; C12D 9/04
See application file for complete search history.

(56) References Cited

U.S. PATENT DOCUMENTS 4,913,747 A 4/1990 Fukuda et al.
9,783,864 B2 10/2017 Andreotti et al.
(Continued)

FOREIGN PATENT DOCUMENTS

CN 1178250 A 4/1998
CN 103131826 A 6/2013
(Continued)

OTHER PUBLICATIONS

Chinese Office Action for Chinese Application No. 201880017677.2, dated Apr. 15, 2021 with Concise Statement of Relevance of Office Action, 9 pages.
(Continued)

*Primary Examiner* — Scott R Kastler
(74) *Attorney, Agent, or Firm* — RatnerPrestia

(57) ABSTRACT

There are provided an apparatus for cooling a rail and a method for manufacturing a rail, capable of inexpensively manufacturing a rail with high hardness and high toughness. The apparatus for cooling a rail, configured to jet a cooling medium to the head portion and foot portion of a rail in an austenite temperature range to forcibly cool the rail, includes: a first cooling unit including plural first cooling headers configured to jet the cooling medium as gas to the head top face and head side of the head portion, and first driving units configured to move at least one first cooling header of the plural first cooling headers to change the jet distance of the cooling medium jetted from the first cooling header; and a second cooling unit including a second cooling header configured to jet the cooling medium as gas to the foot portion.

8 Claims, 3 Drawing Sheets

(51) Int. Cl.

| | |
|---|---|
| ***C21D 1/18*** | (2006.01) |
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/42*** | (2006.01) |
| ***C22C 38/44*** | (2006.01) |
| ***C22C 38/50*** | (2006.01) |
| ***C22C 38/60*** | (2006.01) |
| ***C21D 9/00*** | (2006.01) |

(52) U.S. Cl.

CPC ..... *C21D 6/005* (2013.01); *C21D 6/008* (2013.01); *C21D 8/005* (2013.01); *C21D 9/0062* (2013.01); *C21D 9/04* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/42* (2013.01); *C22C 38/44* (2013.01); *C22C 38/50* (2013.01); *C22C 38/60* (2013.01); *C21D 2211/001* (2013.01)

(56) References Cited

U.S. PATENT DOCUMENTS

| | | | | |
|---|---|---|---|---|
| 10,125,405 | B2 | 11/2018 | Lainati et al. | |
| 2021/0348251 | A1* | 11/2021 | Okushiro | C22C 38/60 |

FOREIGN PATENT DOCUMENTS

| | | | | | |
|---|---|---|---|---|---|
| CN | 104561496 | A | | 4/2015 | |
| CN | 104962717 | B | | 3/2017 | |
| EP | 0293002 | | | 1/1988 | |
| EP | 2573194 | A1 | | 3/2013 | |
| EP | 3099828 | | | 1/2019 | |
| JP | 6213528 | A | | 1/1987 | |
| JP | 63114923 | A | * | 5/1988 | |
| JP | 63114923 | A | | 5/1988 | |
| JP | 01087719 | A | * | 3/1989 | C21D 9/04 |
| JP | 0213012 | B2 | | 4/1990 | |
| JP | 0533057 | A | | 2/1993 | |
| JP | 05331547 | A | | 12/1993 | |
| JP | 0810822 | A | | 1/1996 | |
| JP | 09227942 | A | | 9/1997 | |
| JP | 2014189880 | A | | 10/2014 | |
| JP | 2015523467 | A | | 8/2015 | |
| JP | 2016049568 | A | | 4/2016 | |
| JP | 2016518518 | A | | 6/2016 | |

OTHER PUBLICATIONS

Australian Examination Report for Australian Application No. 2018235626, dated Nov. 5, 2020, 4 pages.

Chinese Office Action with Search Report for Chinese Application No. 201880017677.2, dated Sep. 28, 2020, 11 pages.

Extended European Search Report for European Application No. 18 766 883.5, dated Dec. 13, 2019, 9 pages.

International Search Report and Written Opinion for International Application No. PCT/JP2018/010086, dated May 29, 2018—7 pages.

International Preliminary Report on Patentability for International Application No. PCT/JP2018/010086, dated Sep. 17, 2019, 8 pages.

* cited by examiner

COOLING DEVICE AND PRODUCTION METHOD FOR RAIL

CROSS REFERENCE TO RELATED APPLICATIONS

This is the U. S. National Phase application of PCT/JP2018/010086, filed Mar. 14, 2018, which claims priority to Japanese Patent Application No. 2017-049871, filed Mar. 15, 2017, the disclosures of each of these applications being incorporated herein by reference in their entireties for all purposes.

FIELD OF THE INVENTION

The present invention relates to an apparatus for cooling a rail and a method for manufacturing a rail.

BACKGROUND OF THE INVENTION

High-hardness rails with head portions including a fine pearlite structure have been known as rails excellent in wear resistance and toughness. Such a high-hardness rail is commonly manufactured by the following manufacturing method.

First, a hot-rolled rail in an austenite temperature range or a rail heated in the austenite temperature range is carried into a heat hardening apparatus in the state of being erected. The state of being erected refers to a state in which the head portion of a rail is upper, and the foot underside portion of the rail is lower. In such a case, the rail in the state of remaining having a rolling length of, for example, around 100 m, or in the state of being cut (hereinafter, also referred to as "sawed") into rails each having a length of, for example, around 25 m is transported to the heat hardening apparatus. When the rail is sawed and then transported to the heat hardening apparatus, the heat hardening apparatus may be divided into plural zones having a length according to the sawed rails.

Then, in the heat hardening apparatus, the foot tip portion of the rail is restrained by clamps, and the head top face, head side, foot underside portion, and, in addition, web portion, as needed, of the rail are forcibly cooled by air as a cooling medium. In such a method for manufacturing a rail, an entire head portion including the interior of a rail is allowed to have a fine pearlite structure by controlling a cooling rate in forcible cooling. Forcible cooling in a heat hardening apparatus is commonly performed until the temperature of a head portion reaches around 350° C. to 650° C.

Further, the restraint of the forcibly cooled rail by the clamps is released, and the rail is transported to a cooling bed and then cooled to room temperature.

High wear resistance and high toughness are required by rails under severe environments, for example, working places of natural resources such as coal and iron ore. However, wear resistance is deteriorated when the structure of such a rail is bainite, while toughness is deteriorated when the structure is martensite. Therefore, it is necessary that at least 98% or more of the structure of an entire head portion is a pearlite structure in the structure of the rail. Since a pearlite structure with a finer pearlite lamella spacing exhibits more improvement in wear resistance, the finer lamella spacing is also required.

Since a rail is used until the rail is worn up to 25 mm, wear resistance is required not only by the surface of the head portion of the rail but also by a portion between the surface and the interior of the rail at a depth of 25 mm.

PTL 1 discloses a method in which the temperature of the head portion of a rail being forcibly cooled is measured, the flow rate of a cooling medium is increased after the time at which a temperature history gradient becomes gentle due to generation of heat of transformation, and cooling is intensified to increase the hardness of the surface and interior of the rail.

PTL 2 discloses a method in which cooling with air is performed in the early period of forcible cooling, and cooling with mist is performed in the later period, to achieve the high hardness of a portion up to the center of the head portion of a rail.

PATENT LITERATURE

PTL 1: JP 9-227942
PTL 2: JP 2014-189880

SUMMARY OF THE INVENTION

In the method described in PTL 1, the jet flow rate of the cooling medium is increased, and therefore, the running cost of a blower is increased. Therefore, the running cost has been desired to be reduced.

In the method described in PTL 2, a running cost becomes high, and facilities such as a water supply pipe and a drainage pipe are required, because it is necessary to supply water to perform cooling with mist. Therefore, an increase in the cost of initial investment is problematic. In addition, a cold spot is generated when cooling to a low temperature is performed. Therefore, there has been a possibility that a cooling rate is locally increased to cause transformation to a structure, such as martensite or bainite, resulting in the considerable deterioration of toughness and wear resistance.

Thus, the present invention was made while focusing on such problems, with an object of providing an apparatus for cooling a rail and a method for manufacturing a rail, capable of inexpensively manufacturing a rail with high hardness and high toughness.

In accordance with one aspect of the present invention, there is provided an apparatus for cooling a rail, configured to jet a cooling medium to a head portion and a foot portion of a rail in an austenite temperature range to forcibly cool the rail, the apparatus including: a first cooling unit including a plurality of first cooling headers configured to jet the cooling medium as gas to a head top face and a head side of the head portion, and a first driving unit configured to move at least one first cooling header of the plurality of first cooling headers to change a jet distance of the cooling medium jetted from the first cooling header; and a second cooling unit including a second cooling header configured to jet the cooling medium to the foot portion.

In accordance with one aspect of the present invention, there is provided a method for manufacturing a rail, wherein when a cooling medium is jetted to a head portion and foot portion of a rail in an austenite temperature range to forcibly cool the rail, the cooling medium as gas is jetted from a plurality of first cooling headers to a head top face and a head side of the head portion, the cooling medium is jetted from a second cooling header to the foot portion, and at least one first cooling header of the plurality of first cooling headers is moved to change a jet distance of the cooling medium jetted from the first cooling header.

In accordance with one aspect of the present invention, there are provided an apparatus for cooling a rail and a method for manufacturing a rail, capable of inexpensively manufacturing a rail with high hardness and high toughness.

DETAILED DESCRIPTION OF EMBODIMENTS OF THE INVENTION

Figure 1:
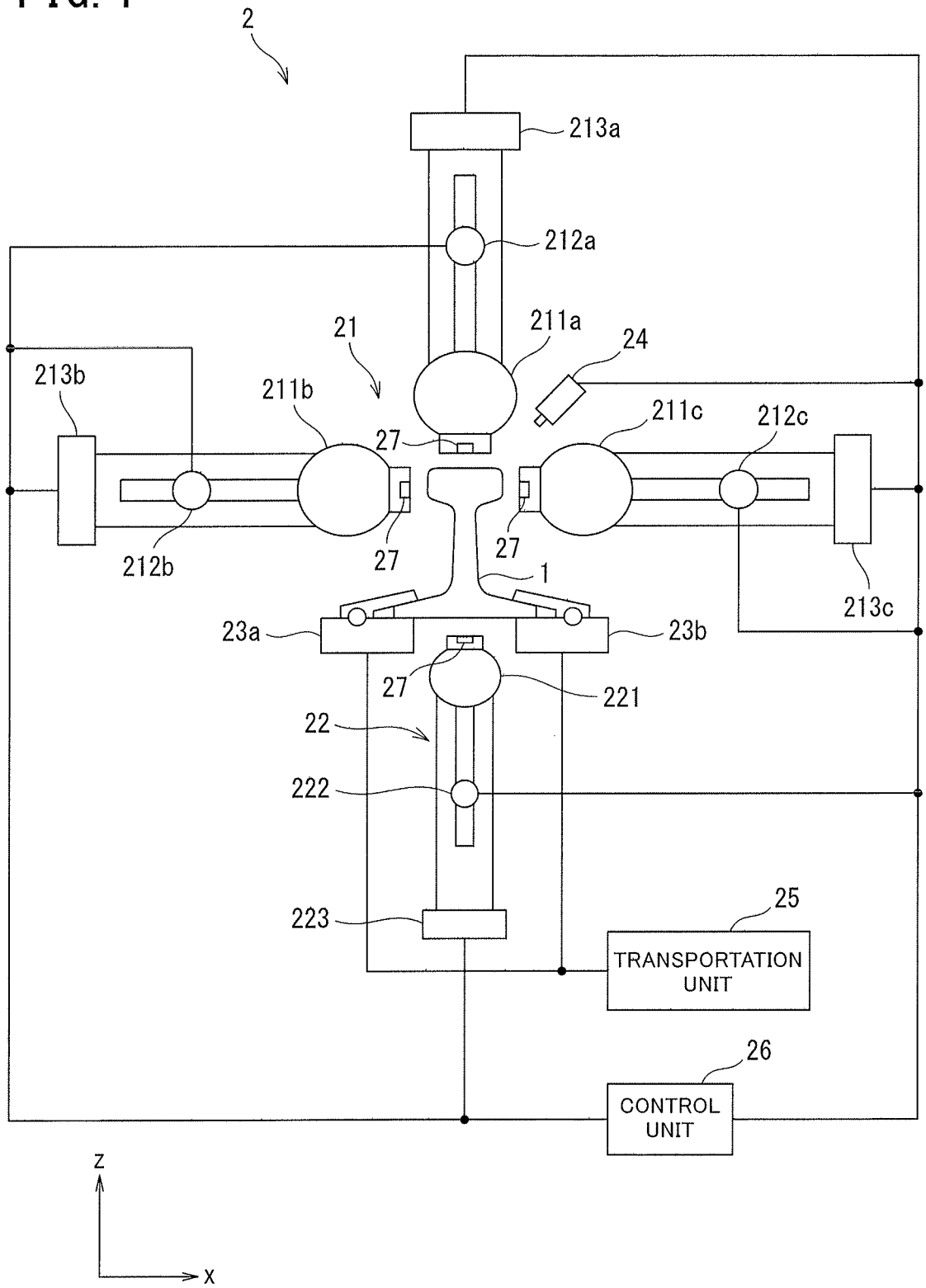
FIG. 1 is a longitudinal cross-sectional schematic view illustrating a cooling apparatus according to one embodiment of the present invention.

In the following detailed descriptions, many specific details will be described to provide a complete understanding of the embodiment of the present invention. However, it is obvious that one or more embodiments can be carried out even without such specific details. In addition, well-known structures and apparatuses are schematically illustrated to simplify the drawings.

<Configuration of Cooling Apparatus>

The configuration of an apparatus 2 for cooling a rail 1 according to one aspect of the present invention will now be described with reference to FIG. 1 to FIG. 4. The cooling apparatus 2 is used in a hot-rolling step described below or a heat hardening step carried out after a hot-sawing step, and forcibly cools the rail 1 at high temperature. As illustrated in FIG. 3, the rail 1 includes a head portion 11, a foot portion 12, and a web portion 13, as viewed in a cross section orthogonal to the longitudinal direction of the rail 1. The head portion 11 and the foot portion 12 are opposed to an upward and downward direction (upward and downward direction of FIG. 3) and each extend in a crosswise direction (lateral direction of FIG. 3), as viewed in the cross section of FIG. 3. The web portion 13 connects the center in the crosswise direction of the head portion 11 arranged in an upper side in the upward and downward direction and the center in the crosswise direction of the foot portion 12 arranged in a lower side, and extends in the upward and downward direction.

Figure 4:
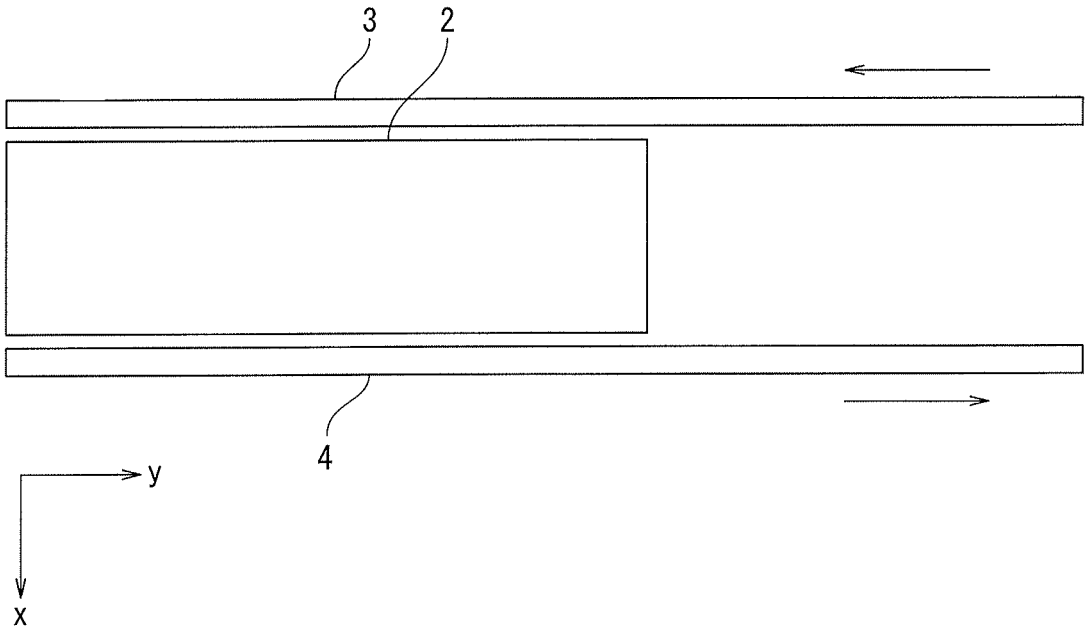
FIG. 4 is a plan view illustrating the peripheral facilities of the cooling apparatus.

As illustrated in FIG. 1, the cooling apparatus 2 includes a first cooling unit 21, a second cooling unit 22, a pair of clamps 23*a* and 23*b*, an in-machine thermometer 24, a transportation unit 25, a control unit 26, and, as needed, distance meters 27. The rail 1 to be forcibly cooled is arranged in an erection posture in the cooling apparatus 2. The erection posture is a state in which the head portion 11 is arranged in a positive direction side in the z-axis direction, which is a vertically upper side, and the foot portion 12 is arranged in a negative direction side in the z-axis direction, which is a vertically lower side. In FIG. 1 and FIG. 4, the x-axis direction is a crosswise direction in which the head portion 11 and the foot portion 12 extend, and the y-axis direction is the longitudinal direction of the rail 1. In addition, the x axis, the y axis, and the z axis are set to be orthogonal to each other.

The first cooling unit 21 includes three first cooling headers 211*a* to 211*c*, three first adjustment units 212*a* to 212*c*, and three first driving units 213*a* to 213*c*, as viewed in the cross section illustrated in FIG. 1.

In the three first cooling headers 211*a* to 211*c*, cooling medium ejection ports arranged at a pitch of several millimeters to 100 mm are disposed to face the head top face (an end face in an upper side in the z-axis direction) and head sides (both end faces in the x-axis direction) of the head portion 11, respectively. In other words, the first cooling header 211*a* is arranged in the upper side which is the positive direction side in the z axis of the head portion 11, the first cooling header 211*b* is arranged in the left side which is the negative direction side in the x axis of the head portion 11, and the first cooling header 211*c* is arranged in the right side which is the positive direction side in the x axis of the head portion 11, as viewed in the cross section illustrated in FIG. 1. With regard to each of the three first cooling headers 211*a* to 211*c*, plural first cooling headers are disposed along the longitudinal direction (the y-axis direction) of the rail 1. The three first cooling headers 211*a* to 211*c* forcibly cool the head portion 11 by jetting cooling medium to the head top face and head sides of the head portion 11 through the cooling medium ejection ports. Air is used as the cooling medium.

The three first adjustment units 212*a* to 212*c* are disposed in the cooling medium supply passages of the three first cooling headers 211*a* to 211*c*, respectively. The three first adjustment units 212*a* to 212*c* include measurement units (not illustrated) configured to measure the supply amounts of the cooling medium in the respective cooling medium supply passages, and flow control valves (not illustrated) configured to adjust the supply amounts of the cooling medium. In addition, the three first adjustment units 212*a* to 212*c* are electrically connected to the control unit 26, and send, to the control unit 26, the results of flow rates measured by the measurement units. Further, the three first adjustment units 212*a* to 212*c* receive control signals acquired from the control unit 26, to operate the flow control valves and to adjust the jet flow rates of the jetted cooling medium. In other words, the three first adjustment units 212*a* to 212*c* monitor and adjust the flow rate of the jetted cooling medium. The three first adjustment units 212*a* to 212*c* are disposed in the plural first cooling headers disposed along the longitudinal direction of the rail 1, respectively, with regard to the three first cooling headers 211*a* to 211*c*.

The three first driving units 213*a* to 213*c* are actuators, such as a cylinder and an electric motor, connected and disposed to the three first cooling headers 211*a* to 211*c*, respectively, and can move the first cooling header 211*a* in the z-axis direction, and the first cooling headers 211*b* and 211*c* in the x-axis direction. The three first driving units 213*a* to 213*c* are electrically connected to the control unit 26, receive control signals acquired from the control unit 26, and move the three first cooling headers 211*a* to 211*c* in the z-axis direction or the x-axis direction. In other words, the three first driving units 213*a* to 213*c* allow the three first cooling headers 211*a* to 211*c* to be moved, respectively, to adjust the jet distances of the cooling medium, respectively, as distances between the jet surfaces of the three first cooling headers 211*a* to 211*c* and the head top face and head sides of the head portion 11. The jet distances are defined as distances between the respective surfaces of the rail 1 and the jet surfaces of the first cooling headers 211*a* to 211*c*, facing the respective surfaces. The jet distances are adjusted by driving the first driving units 213*a* to 213*c* to adjust the x-axis direction positions and the z-axis direction position of the headers. In such a case, for example, relationships between the z-axis direction position or x-axis direction positions of the first cooling headers 211*a* to 211*c*, and the jet distances in the state of pinch-holding both lateral ends of the foot portion 12 of the rail 1 by the clamps 23*a* and 23*b* described below are measured according to each product dimension of the rail in advance. Then, the z-axis direction position or x-axis direction positions of the first cooling headers 211*a* to 211*c* are set based on the relationships for the dimension of the rail to be cooled, to enable the jet distances of interest to be obtained. Further, after start of cooling by the cooling apparatus 2, the first driving units 213*a* to 213*c* are driven based on the results of temperature measurement by the in-machine thermometer 24, to change the jet distances to allow a cooling rate to be within a target range. In other words, when the cooling rate is higher than the target range, the first driving units 213*a* to 213*c* are driven to adjust the jet distances to be increased, to decrease the cooling rate. In contrast, when the cooling rate is lower than the target range, the first driving units 213*a* to 213*c* are driven to adjust the jet distance to be decreased, to increase the cooling rate.

Figure 2:
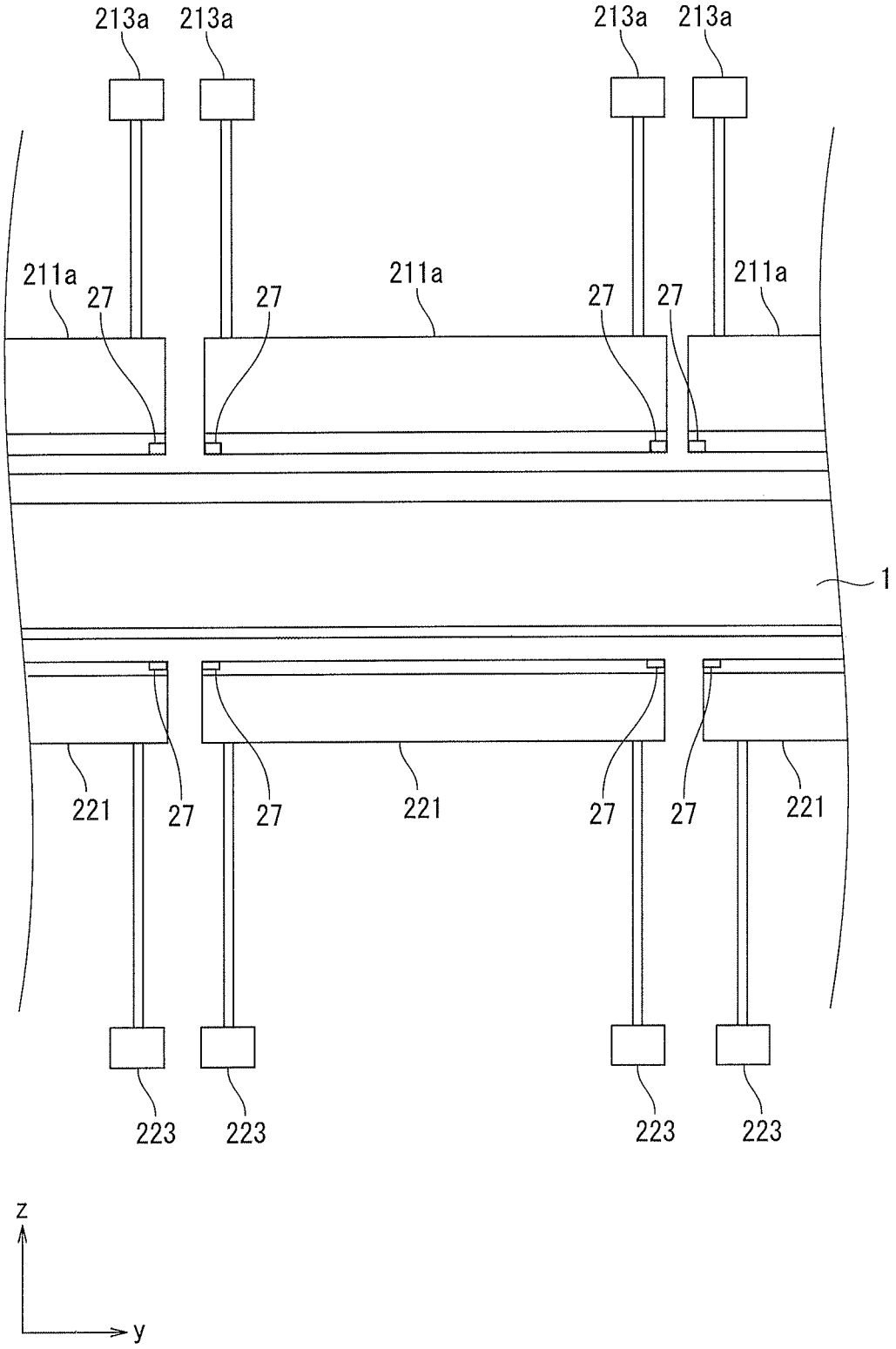
FIG. 2 is a cross-sectional schematic view of the center in the crosswise direction of a cooling apparatus according to one embodiment of the present invention.
Figure 3:
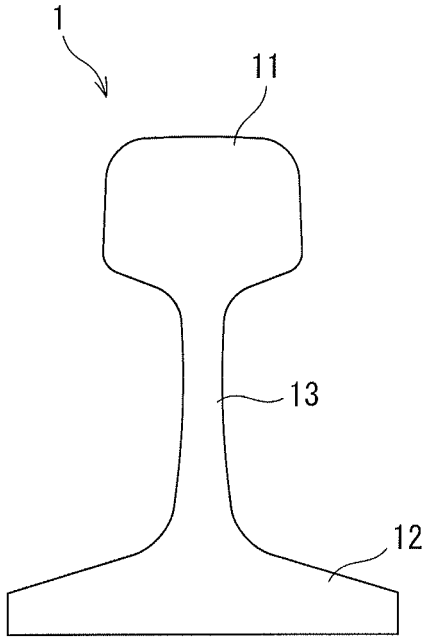
FIG. 3 is a cross-sectional view illustrating each site of a rail.

With regard to the adjustment of the jet distances, the jet distances may be adjusted by placing, on the respective first cooling headers 211*a* to 211*c*, the distance meters 27 configured to measure distances to the surfaces of the rail 1, faced by the respective headers, as illustrated in FIG. 1 or FIG. 2, and driving the first driving units 213*a* to 213*c* on the basis of the values of the jet distances measured by the distance meters 27. In such a case, an apparatus configured to control driving of the first driving units 213*a* to 213*c* on the basis of the values of the measurement by the distance meters 27 is disposed. The control unit 26 may be allowed to have the function of the apparatus. To that end, signals from the distance meters 27 are allowed to be sent to the control unit 26. Measurement apparatuses such as laser displacement meters and vortex flow type displacement meters can be used as the distance meters 27.

In a stage in which the rail 1 is transported to the cooling apparatus 2, or in cooling of the rail 1 by the cooling apparatus 2, bending in an upward and downward direction (z-axis direction in FIG. 1) (hereinafter, also referred to as "warpage") or bending in a lateral direction (x-axis direction in FIG. 1) (simply also referred to as "bending") may occur in the rail 1. The presence or absence, and degrees of the warpage and the bending influence an actual jet distance. In addition, the presence or absence, and degrees of the warpage and the bending differ according to each rail as a material to be cooled. Therefore, it is preferable that the first driving units 213*a* to 213*c* are driven on the basis of the results of the jet distances measured by the distance meters 27, and the jet distances are allowed to be close to target jet distances, to further improve the accuracy of adjusting the jet distances.

Further, for example, in the case of taking the first cooling header 211*a* as an example, the distance meter 27 may be disposed on each of both end sides in the longitudinal direction (y-axis direction) of each of the plural first cooling headers 211*a* arranged along the longitudinal direction (y-axis direction in FIG. 2) as illustrated in FIG. 2. The disposition of the distance meters 27 on each first cooling header 211*a* in such a manner also enables the z-axis direction position (upward and downward direction position) of each first cooling header 211*a* to be adjusted so that the first cooling headers 211*a* fit the shape of the rail, i.e., distances between the first cooling headers 211*a* and the rail 1 are equal to each other, even when warpage occurs in the rail 1, and the rail 1 is deformed in the wave shape in the longitudinal direction. Thus, the influence of the warpage of the rail 1 can be avoided to adjust the jet distance of each first cooling header 211*a*. Even when warpage occurs in the rail 1, a change in the cross-sectional shape of the rail 1 is less than the amount of warpage toward the upward and downward direction, and therefore, the first driving units 213*a* may be driven based on distance meters 27 disposed on second cooling headers 221 described below, instead of the distance meters 27 disposed on the first cooling headers 211*a*.

Like the first cooling headers 211*a*, the distance meters 27 may also be disposed on the first cooling headers 211*b* and 211*c* to drive the driving units 213*b* and 213*c* on the basis of the values of measurement by the distance meters. In such a manner, the influence of the occurrence of the lateral bending of the rail 1 on the jet distances can be similarly avoided.

After the start of the cooling by the cooling apparatus 2, the first driving units 213*a* to 213*c* are driven based on the result of a temperature measured by the in-machine thermometer 24, and the jet distances are changed to allow the cooling rates within the target range or to allow the cooling rates to be close to the target range. In such a case, the situations of the warpage in the upward and downward direction and the bending in the lateral direction may be changed in the cooling to change the jet distances due to the influences of the warpage and the bending. However, since a distance between each header and the rail surface facing each header can be measured by the distance meter 27 even in such a case, the jet distances can be correctly set in consideration the changes of the jet distances due to the occurrence of the warpage.

The three first driving units 213*a* to 213*c* are disposed on the three first cooling headers 211*a* to 211*c*, respectively, and the plural first cooling headers are disposed along the longitudinal direction of the rail 1 with regard to each of the three first cooling headers 211*a* to 211*c*.

The second cooling unit 22 includes the second cooling header 221, a second adjustment unit 222, and second driving units 223*e*.

Cooling medium ejection ports arranged at a pitch of several millimeters to 100 mm are disposed in the second cooling header 221 to face the undersurface (the end face of the lower side in the upward and downward direction) of the foot portion 12. In other words, the second cooling header 221 is disposed below the foot portion 12, as viewed in the cross section illustrated in FIG. 1. In addition, the plural second cooling headers 221 are disposed along the longitudinal direction of the rail 1. The second cooling headers 221 forcibly cool the foot portion 12 by jetting a cooling medium from the cooling medium ejection ports to the undersurface of the foot portion 12. Air is used as the cooling medium.

The second adjustment unit 222 is disposed in the cooling medium supply passage of the second cooling header 221. The second adjustment unit 222 includes: a measurement unit (not illustrated) configured to measure the amount of supplied cooling medium in the cooling medium supply passage; and a flow control valve (not illustrated) configured to adjust the amount of supplied cooling medium. In addition, the second adjustment unit 222 is electrically connected to the control unit 26, sends, to the control unit 26, the result of a flow rate measured by the measurement unit, receives a control signal acquired from the control unit 26 to operate the flow control valve, and adjusts the jet flow rate of the jetted cooling medium. In other words, the second adjustment unit 222 monitors and adjusts the flow rate of the jetted cooling medium. Such second adjustment units 222 are disposed in the respective plural second cooling headers 221 disposed along the longitudinal direction of the rail 1. In the following description, the first cooling headers 211*a* to 211*c* and the second cooling header 221 are also generically referred to as "cooling header".

The second driving units 223 are actuator such as a cylinder and an electric motor, of which each is connected and disposed to the second cooling header 221, and can move the second cooling header 221 in the upward and downward direction. The second driving units 223 is electrically connected to the control unit 26, and receive a control signal acquired from the control unit 26 to move the second cooling header 221 in the upward and downward direction. In other words, the second driving units 223 allow the second cooling header 221 to be moved to adjust the jet distance of the cooling medium, which is the distance between the jet surface of the second cooling header 221 and the undersurface of the foot portion 12. The jet distance in such a case is defined as a distance between the undersurface of the foot portion 12 and the jet face of the second cooling header 221, facing the undersurface. The jet distance is adjusted by driving the second driving units 223 to adjust the z-axis direction position of the second cooling header 221. In such a case, a relationship between the z-axis direction position of the second cooling header 221 and the jet distance is measured in advance, for example, in the state of pinch-holding both lateral ends of the foot portion 12 of the rail 1 by the clamps 23*a* and 23*b* described below. The jet distance of interest can be obtained by setting the z-axis direction position of the second header 221 on the basis of the relationship.

Alternatively, as illustrated in FIG. 1 or FIG. 2, the distance meters 27 configured to measure the distance to the undersurface of the foot portion 12 faced by the second cooling header 221 may be placed on the second cooling header 221, and the second driving units 223 may be driven based on the results of the jet distance measured by the distance meters 27, to adjust the jet distance. In such a case, an apparatus configured to control the driving of the second driving units 223 on the basis of the value of the jet distance measured by the distance meters 27. The control unit 26 may also be allowed to have the function of the apparatus. To that end, signals from the distance meters 27 are allowed to be sent to the control unit 26. The distance meters 27 are similar to the distance meters 27 disposed on the first cooling units 211*a* to 211*c*, and measurement apparatuses such as laser displacement meters and vortex flow type displacement meters are used as the distance meters 27.

The presence or absence, and degree of warpage occurring in the stage of the transportation to the cooling apparatus 2, or in the cooling by the cooling apparatus 2 differ according to each rail as a material to be cooled. Therefore, it is preferable to drive the second driving units 223 on the basis of the value of the jet distance measured by the distance meters 27, to further improve the accuracy of adjusting the jet distance, in a manner similar to the manner of the first cooling headers 211*a* to 211*c*. In such a case, the second driving units 223 may be driven based on the value of the distance measured by the distance meters 27 disposed on the first cooling header 211*a*, rather than the distance meters 27 disposed on the second cooling header 221.

Like the first cooling headers 211*a* to 211*c*, the distance meters 27 may be disposed on both end sides in the longitudinal direction of each of the plural second cooling headers 221 arranged along the longitudinal direction, as illustrated in FIG. 2. The disposition of the distance meters 27 on each second cooling header 221 in such a manner also enables the z-axis direction position of each second cooling header 221 to be adjusted so that the second cooling headers 221 fit the shape of the rail, i.e., distances between the second cooling headers 221 and the rail 1 are equal to each other, even when warpage occurs in the rail 1, and the rail 1 is deformed in the wave shape in the longitudinal direction. Thus, the influence of the warpage of the rail 1 can be avoided to adjust the jet distance of each second cooling header 221. Even when warpage occurs in the rail 1, a change in the cross-sectional shape of the rail 1 is less than the amount of warpage toward the upward and downward direction, and therefore, the second driving units 223 may be driven based on the distance meters 27 disposed on the first cooling headers 211*a*, instead of the distance meters 27 disposed on the second cooling headers 221.

The second driving units 223 are disposed on each of the plural first cooling headers 221 disposed in the longitudinal direction of the rail 1.

In addition, the first cooling unit 21 and the second cooling unit 22 preferably include mechanisms capable of changing positions, at which the first cooling unit 21 and the second cooling unit 22 are placed, so that the cooling headers are at the predetermined positions described above with respect to the head portion 11 and foot portion 12 of the rail 1, to correspond to the dimension of the rail 1, varying according to a standard.

The clamps 23*a* and 23*b* in the pair are apparatuses configured to pinch-hold both respective lateral ends of the foot portion 12 to support and restrain the rail 1. With regard to each of the clamps 23*a* and 23*b* in the pair, the plural clamps are disposed at a spacing of several meters over the longitudinal full length of the rail 1.

The in-machine thermometer 24 is a non-contact type thermometer such as a radiation thermometer, and measures the surface temperature of at least one place of the head portion 11. The in-machine thermometer 24 is electrically connected to the control unit 26, and sends the measurement result of the surface temperature of the head top face to the control unit 26. In addition, the in-machine thermometer 24 continuously measures the surface temperature of the head portion at predetermined time intervals during the forcible cooling of the rail 1.

The transportation unit 25 is a transportation apparatus connected to the pair of clamps 23*a* and 23*b*, and moves the pair of clamps 23*a* and 23*b* in the longitudinal direction of the rail 1 to transport the rail 1 in the cooling apparatus 2.

The control unit 26 adjusts the jet distance and jet flow rate of a cooling medium by controlling the three first adjustment units 212*a* to 212*c*, the second adjustment unit 222, the three first driving units 213*a* to 213*c*, and the second driving units 223 on the basis of the result of measurement by the in-machine thermometer 24. As a result, the control unit 26 adjusts the cooling rate of the head portion 11 to achieve a target cooling rate. A method for adjusting the jet distance and jet flow rate of a cooling medium by the control unit 26 will be described later.

As illustrated in FIG. 4, a carrying-in table 3 and a carrying-out table 4 are disposed in the vicinity of the cooling apparatus 2. The carrying-in table 3 is a table configured to transport the rail 1 from a preceding step such as the hot-rolling step to the cooling apparatus 2. The carrying-out table 4 is a table configured to transport the rail 1 heat-hardened in the cooling apparatus 2 to a subsequent step such as a cooling bed or an inspection facility.

<Method for Manufacturing Rail>

A method for manufacturing a rail according to the present embodiment will now be described. In the present embodiment, the rail 1 based on pearlite excellent in wear resistance and toughness is manufactured. For example, a steel including the following chemical compositions can be used in the rail 1. An expression of "%" with regard to the chemical compositions means "percent by mass" unless otherwise specified.

C: 0.60% or More and 1.05% or Less

C (carbon) is an important element forming cementite to increase hardness and strength and improving wear resistance in a pearlite-based rail. However, since a C content of less than 0.60% causes such effects to be small, the content of C is preferably 0.60% or more, and more preferably 0.70% or more. In contrast, the excessive content of C causes the amount of cementite to be increased, and can be therefore expected to allow hardness and strength to be increased but adversely results in the deterioration of ductility. In addition, the increased content of C results in increase in a temperature range in a $\gamma+\theta$ region to promote softening of a heat affected zone. In consideration of such adverse effects, the content of C is preferably 1.05% or less, and more preferably 0.97% or less.

Si: 0.1% or More and 1.5% or Less

Si (silicon) is added as a deoxidizer and for strengthening a pearlite structure in a rail material. A Si content of less than 0.1% causes such effects to be small. Therefore, the content of Si is preferably 0.1% or more, and more preferably 0.2% or more. In contrast, the excessive content of Si promotes decarbonization, and promotes generation of defects on a surface of the rail 1. Therefore, the content of Si is preferably 1.5% or less, and more preferably 1.3% or less.

Mn: 0.01% or More and 1.5% or Less

Since Mn (manganese) has the effect of decreasing a pearlite transformation temperature and reducing pearlite lamella spacings, Mn is an element effective for maintaining the high hardness of a portion up to the interior of the rail 1. However, a Mn content of less than 0.01% causes the effect to be small. Therefore, the content of Mn is preferably 0.01% or more, and more preferably 0.3% or more. In contrast, a Mn content of more than 1.5% results in a decrease in equilibrium transformation temperature (TE) of pearlite and in easier occurrence of martensitic transformation of a structure. Therefore, the content of Mn is preferably 1.5% or less, and more preferably 1.3% or less.

P: 0.035% or Less

A P (phosphorus) content of more than 0.035% results in the deterioration of toughness and ductility. Therefore, it is preferable to reduce the content of P. Specifically, the content of P is preferably 0.035% or less, and more preferably 0.025% or less. Special smelting performed to minimize the content of P results in an increase in cost in melting. Therefore, the content of P is preferably 0.001% or more.

S: 0.030% or Less

S (sulfur) forms coarse MnS extending in a rolling direction and deteriorating ductility and toughness. Therefore, it is preferable to reduce the content of S. Specifically, the content of S is preferably 0.030% or less, and more preferably 0.015% or less. The minimization of the content of S causes a melting treatment time period and the amount of solvent to be increased to considerably increase a cost in melting. Therefore, the content of S is preferably 0.0005% or more.

Cr: 0.1% or More and 2.0% or Less

Cr (chromium) results in an increase in equilibrium transformation temperature (TE), contributes to a reduction in pearlite lamella spacing, and causes hardness and strength to be increased. With the effect of combination with Sb, Cr is effective for inhibiting generation of a decarburized layer. Therefore, the content of Cr is preferably 0.1% or more, and more preferably 0.2% or more. In contrast, a Cr content of more than 2.0% results in an increase in the possibility of generation of a weld defect and in an increase in hardenability, and promotes the generation of martensite. Therefore, the content of Cr is preferably 2.0% or less, and more preferably 1.5% or less.

The total of the contents of Si and Cr is desirably 2.0% or less. This is because when the total of the contents of Si and Cr is more than 2.0%, the adhesiveness of scale is excessively increased, and therefore, the scale may be inhibited from peeling to promote decarbonization.

The steel used in the rail 1 may further include one or more elements of 0.5% or less of Sb, 1.0% or less of Cu, 0.5% or less of Ni, 0.5% or less of Mo, 0.15% or less of V, and 0.030% or less of Nb, as well as the chemical compositions described above.

Sb: 0.5% or Less

Sb (antimony) has the prominent effect of preventing decarbonization during heating of a rail steel material in a heating furnace. In particular, Sb has the effect of reducing a decarburized layer in a case in which the content of Sb is 0.005% or more when Sb is added together with Cr. Therefore, in the case of containing Sb, the content of Sb is preferably 0.005% or more, and more preferably 0.01% or more. In contrast, a Sb content of more than 0.5% causes the effect to be saturated. Therefore, the content of Si is preferably 0.5% or less, and more preferably 0.3% or less. Even when Sb is not positively allowed to be contained, Sb may be contained as an impurity in a content of 0.001% or less.

Cu: 1.0% or Less

Cu (copper) is an element capable of further enhancing hardness by solid-solution strengthening. Cu also has the effect of suppressing decarbonization. When Cu is allowed to be contained with the expectation of the effect, the content of Cu is preferably 0.01% or more, and more preferably 0.05% or more. In contrast, a Cu content of more than 1.0% is prone to result in occurrence of surface cracking due to embrittlement in continuous casting or rolling. Therefore, the content Cu is preferably 1.0% or less, and more preferably 0.6% or less.

Ni: 0.5% or Less

Ni (nickel) is an element effective for improving toughness and ductility. In addition, Ni is also an element effective for suppressing Cu cracking by adding Ni together with Cu. Therefore, it is desirable to add Ni in the case of adding Cu. However, it is impossible to obtain such effects in a case in which the content of Ni is less than 0.01%. Therefore, when Ni is allowed to be contained with the expectation of the effects, the content of Ni is preferably 0.01% or more, and more preferably 0.05% or more. In contrast, a Ni content of more than 0.5% results in an increase in hardenability, and promotes the generation of martensite. Therefore, the content of Ni is preferably 0.5% or less, and more preferably 0.3% or less.

Mo: 0.5% or Less

Mo (molybdenum) is an element effective for enhancing strength. However, a Mo content of less than 0.01% causes such an effect to be small. Therefore, the content of Mo is preferably set at 0.01% or more, and more preferably at 0.05% or more, to allow Mo to contribute to the enhancement of strength. In contrast, a Mo content of more than 0.5% results in an increase in hardenability and the generation of martensite, and therefore causes toughness and ductility to be extremely deteriorated. Therefore, the content of Mo is preferably 0.5% or less, and more preferably 0.3% or less.

V: 0.15% or Less

V (vanadium) is an element forming VC, VN, or the like, being finely precipitated into ferrite, and contributing to higher strength through precipitation strengthening of ferrite. In addition, V also functions as a trap site for hydrogen, and can be expected to have the effect of suppressing delayed cracking. To obtain these effects of V, the content of V is preferably set at 0.001% or more, and more preferably 0.005% or more. In contrast, addition of more than 0.15% of V results in a considerable increase in alloy cost whereas causing the effects to be saturated. Therefore, the content of V is preferably 0.15% or less, and more preferably 0.12% or less.

Nb: 0.030% or Less

Nb (niobium) is effective for increasing an austenite unrecrystallization temperature range to a higher temperature side, promoting the introduction of work strain into austenite in rolling, and thus allowing a pearlite colony and a block size to be finer. In consideration of this, Nb is an element effective for improving ductility and toughness. To obtain these effects of Nb, the content of Nb is preferably set at 0.001% or more, and more preferably at 0.003% or more. In contrast, a Nb content of more than 0.030% results in crystallization of a Nb carbonitride in a solidification process in the casting of a rail steel material such as a bloom, to deteriorate cleanability. Therefore, the content of Nb is preferably 0.030% or less, and more preferably 0.025% or less.

The balance other than the compositions described above includes Fe (iron) and unavoidable impurities. It is acceptable that N (nitrogen) in an amount of up to 0.015%, O (oxygen) in an amount of up to 0.004%, and H (hydrogen) in an amount of up to 0.0003% are contained as unavoidable impurities. In addition, the deterioration of a rolling fatigue characteristic due to rigid AlN or TiN is suppressed. Therefore, the content of Al is preferably 0.001% or less. The content of Ti is preferably 0.002% or less, and still more desirably 0.001% or less. The chemical compositions of the rail 1 preferably include the compositions described above, and the balance of Fe and unavoidable impurities.

In the method for manufacturing the rail 1 according to the present embodiment, first, for example, a bloom having the chemical compositions described above, as a material of the rail 1 cast by a continuous casting method, is carried into a heating furnace, and heated to −1100° C. or more.

Then, the heated bloom is rolled in one or more passes by each of a break down mill, a roughing mill, and a finishing mill, and finally rolled into the rail 1 having a shape illustrated in FIG. 2 (hot-rolling step). In such a case, the rolled rail 1 has a longitudinal length of around 50 m to 200 m, and is hot-sawed to have a length of, for example, 25 m, as needed (hot-sawing step). When the longitudinal length of the rail 1 is short, the influence of a cooling medium jetted to longitudinal end faces unintentionally occurs in the case of cooling in a subsequent heat hardening step. Therefore, the longitudinal length of the rail 1 used in the heat hardening step is set at three or more times a height between the top surface of the head portion 11 of the rail 1 (the end face in a z-axis negative direction) and the undersurface of the foot portion 12 (the end face in the z-axis negative direction). The upper limit of the longitudinal length of the rail 1 used in the heat hardening step is set at a rolling length (a maximum rolling length in the hot-rolling step).

The hot-rolled or hot-sawed rail 1 is transported to the cooling apparatus 2 by the carrying-in table 3, and cooled by the cooling apparatus 2 (heat hardening step). In such a case, the temperature of the rail 1 transported to the cooling apparatus 2 is desirably in an austenite temperature range. Because it is necessary that a rail used for a mine or a curved section is allowed to have high hardness, it is necessary to rapidly cool the rail by the cooling apparatus 2 after rolling. This is because a structure having high hardness is achieved by allowing a pearlite lamella spacing to be finer. Such a structure having high hardness can be obtained by increasing the degree of undercooling in transformation, i.e., by increasing a cooling rate in transformation. However, when transformation of the structure of the rail 1 occurs before the cooling by the cooling apparatus 2, the transformation occurs at a very low cooling rate in natural radiational cooling, and therefore, it is impossible to obtain the structure having high hardness. Accordingly, it is preferable to perform the heat hardening step after reheating the rail 1 to the austenite temperature range, in a case in which the temperature of the rail 1 is lower than the austenite temperature range when the cooling is started by the cooling apparatus 2.

However, it is not necessary to perform the reheating in a case in which the temperature of the rail 1 is in the austenite temperature range when the cooling is started by the cooling apparatus 2.

In the heat hardening step, the rail 1 is transported to the cooling apparatus 2, and the foot portion 12 of the rail 1 is then restrained by the clamps 23*a* and 23*b*. Then, cooling medium are jetted from the three first cooling headers 211*a* to 211*c* and the second cooling header 221, to rapidly cool the rail 1. In such a case, a cooling rate in heat hardening is preferably varied depending on desired hardness, and, in addition, the excessive increase of the cooling rate may result in the occurrence of martensitic transformation and in the deterioration of toughness. Therefore, the control unit 26 calculates a cooling rate from the result of a temperature measured by the in-machine thermometer 24 during cooling, to adjust the jet distances and jet flow rates of the cooling medium on the basis of the obtained cooling rate and a target cooling rate set in advance.

Specifically, when the calculated cooling rate is lower than the target cooling rate, the control unit 26 controls the three first adjustment units 212*a* to 212*c*, the second adjustment unit 222, the three first driving units 213*a* to 213*c*, and the second driving units 223 so that the jet distances of the cooling medium are decreased, and the jet flow rates of the cooling medium are increased. In contrast, when the calculated cooling rate is higher than the target cooling rate, the control unit 26 controls the three first adjustment units 212*a* to 212*c*, the second adjustment unit 222, the three first driving units 213*a* to 213*c*, and the second driving units 223 so that the jet distances of the cooling medium are increased, and the jet flow rates of the cooling medium are decreased. In such a case, the control unit 26 may stop the jetting of the cooling medium to perform cooling by natural radiational cooling, as needed.

With regard to the adjustment of the jet distances and jet flow rates of the cooling medium, the jet distances and the jet flow rates may be simultaneously adjusted, or the jet distances may be preferentially adjusted. To facilitate the control, the heat hardening step may be divided into plural stages (cooling steps) on the basis of an estimated temperature history or the like, and either the jet distances or jet flow rates of the cooling medium may be set to be constant in each stage. The other jet distances or jet flow rates which are not set to be constant may be adjusted to achieve the target cooling rate from the cooling rate obtained based on the result of the measurement by the in-machine thermometer 24. The control unit 26 adjusts the cooling rate on the basis of the result of the measurement by the in-machine thermometer 24 at an optional time interval such as a measurement interval of the in-machine thermometer 24 or each stage of the heat hardening step.

When such a jet distance which is a gap between such a cooling header and the rail 1 is too short, the deformation of the rail 1 allows the cooling header and the rail 1 to come into contact with each other and causes a facility to be damaged. Therefore, the jet distance is preferably set at 5 mm or more. In contrast, when the jet distance is too long, the velocity of the jetted air is attenuated, and therefore, cooling performance equivalent to natural radiational cooling is achieved. As described above, a considerable decrease in cooling rate results in the degradation of hardness, and therefore, the upper limit of the jet distance is preferably set at 200 mm. However, it is not necessary to particularly limit the upper limit. When the movement distance of each cooling header is increased by the three first driving units 213*a* to 213*c* and the second driving units 223, it is necessary to allow the stroke of a cylinder to be long, and therefore, an initial capital investment cost is increased. Therefore, the upper limit of the jet distance may be set from the viewpoint of the capital investment cost.

In such a case, the head portion 11 is primarily cooled to allow the structure of the head portion 11 of the rail 1 to be a fine pearlite structure having high hardness and excellent toughness in the cooling by the first cooling unit 21. In the cooling by the second cooling unit 22, the foot portion 12 is primarily cooled to suppress the upward and downward warpage (bending in the upward and downward direction) of the full length of the rail 1, caused by a difference between the temperatures of the head portion 11 and the foot portion 12. As a result, a temperature balance between the head portion 11 and the foot portion 12 is controlled. When the hardness of the head portion 11 of the rail 1 is intended to be increased, it is necessary to enhance the cooling rate (cooling amount) of the head portion 11, and therefore, it is effective to move at least one or more first cooling headers 211*a* to 211*c* of the first cooling headers 211*a* to 211*c* disposed at three places to shorten a jet distance. When the cooling rate of the head portion 11 is enhanced, it is necessary to also raise the cooling rate of the foot portion 12 to suppress upward and downward warpage. In such a case, it is effective to move the second cooling header 221 to shorten the jet distance. In other words, it is preferable to select a cooling header configured to change a jet distance according to, e.g., a target structure or application.

In addition, it is necessary to finish transformation up to a depth intended to have high hardness in heat hardening to allow the transformation to occur in the heat hardening to make a structure having high hardness, as described above. A depth at which a structure having high hardness is required is set as appropriate according to an application in use. Cooling is performed until the surface of the head portion 11 reaches a temperature depending on at least the depth at which the structure having high hardness is required. For example, it is necessary to perform cooling until the surface temperature of the head portion 11 reaches 550° C. or less when a structure having a high hardness of around HB 330 to 390 is required from the surface to a depth of 15 mm, or until the surface temperature of the head portion 11 reaches 500° C. or less when a structure having a high hardness of HB 390 or more is required up to a depth of 15 mm. In addition, it is necessary to perform cooling until the surface temperature of the head portion 11 reaches 450° C. or less when a structure having a high hardness of around HB 330 to 390 is required from the surface to a depth of 25 mm, or until the surface temperature of the head portion 11 reaches 445° C. or less when a structure having a high hardness of HB 390 or more is required from the surface to a depth of 25 mm.

After the heat hardening step, the rail 1 is transported to a cooling bed by the carrying-out table 4, and is cooled to ordinary temperature to 200° C. on the cooling bed. The rail 1 is inspected and then shipped. In the inspection, a Vickers hardness test or a Brinell hardness test is conducted.

High wear resistance and high toughness are required by the rail 1 under a severe environment of a working place of a natural resource such as coal or iron ore. Therefore, it is unfavorable that the rail 1 used under such an environment has a bainite structure deteriorating wear resistance or a martensite structure deteriorating resistance to fatigue and damage, and it is preferable that the rail 1 has a pearlite structure of 98% or more. A pearlite structure of which the lamella spacings are allowed to be finer and the hardness is enhanced results in improvement in wear resistance. The wear resistance is required not only by the surface of the head portion 11 just after manufacturing but also by the worn surface. Although a criterion of replacement of the rail 1 differs according to a railroad company, predetermined hardness is required from a surface to a depth of 25 mm because the rail 1 is utilized at a maximum depth of 25 mm. Particularly in a curve section, a centrifugal force acts on a train, and therefore, a large force is applied to the rail 1, which is prone to be worn. The life of the curve section can be prolonged by allowing the surface of the head portion 11 of the rail 1 to have a hardness of HB 420 or more, and allowing a depth used to have a hardness of HB 390 or more.

Alternative Example

The present invention has been described above with reference to the specific embodiment. However, the invention is not intended to be limited to the descriptions. Other embodiments of the present invention as well as various alternative examples of the disclosed embodiment are apparent to those skilled in the art with reference to the descriptions of the present invention. Accordingly, the claims should be considered to also include the alternative examples or embodiments included in the scope and gist of the present invention.

For example, in the embodiment described above, the cooling rate of the head portion 11 is controlled by adjusting the jet distances and jet flow rates of the cooling medium jetted to the head portion 11. However, the present invention is not limited to such examples. For example, the cooling rate of the head portion 11 may be adjusted by allowing the jet flow rates of the cooling medium jetted to the head portion 11 to be constant and by adjusting only the jet distances of the cooling medium jetted to the head portion 11. In such a case, the control unit 26 adjusts the cooling rate by controlling the three first driving units 213*a* to 213*c* and the second driving units 223 to control the jet distances according to the result of measurement by the in-machine thermometer 24. In such a configuration, the jet flow rates are constant and easily controlled, and therefore, the configurations of the first cooling unit 21 and the second cooling unit 22 can be simplified.

In addition, the embodiment described above have a configuration in which the three first driving units 213*a* to 213*c* are disposed on the three first cooling headers 211*a* to 211*c*, respectively. However, the present invention is not limited to such an example. As described above, it is acceptable that the jet distance of the cooling medium from at least one first cooling header of the three first cooling headers 211*a* to 211*c* can be adjusted. Therefore, a configuration in which at least one cooling header on which the first driving unit is disposed, of the three first cooling headers

211*a* to 211*c*, can be moved is acceptable, and a configuration in which all the first cooling headers 211*a* to 211*c* can be moved in a certain direction by one first driving unit is acceptable.

In the embodiment described above, the adjustment of the cooling rate of the foot portion 12 is controlled by adjusting the jet distances and jet flow rates of the cooling medium jetted to the foot portion 12 according to a change in the cooling rate of the head portion 11. However, the present invention is not limited to such an example. For example, the adjustment of the cooling rate of the foot portion 12 may be performed by adjusting only either the jet distances or jet flow rates of the cooling medium jetted to the foot portion 12. It is also acceptable to forcibly cool the foot portion 12 at constant jet distances and jet flow rates without adjusting the jet distances and jet flow rates of the cooling medium jetted to the foot portion 12 when upward and downward warpage caused by a difference between the cooling rates of the head portion 11 and foot portion 12 of the rail 1 is unproblematic.

In addition, the specific chemical compositions have been described as an example in the embodiment described above. However, the present invention is not limited to such an example. As the chemical compositions of a steel used, chemical compositions other than the above may be used based on a use application and required characteristics.

In addition, the jet distances and jet flow rates of the cooling medium are controlled based on the result of measurement by the in-machine thermometer 24, in the embodiment described above. However, the present invention is not limited to such an example. For example, when a change in temperature in the heat hardening step can estimated based on the numerical analysis of the surface temperature or temperature change of the rail 1 in the heat hardening step, past performance, or the like, the jet distances and jet flow rates of the cooling medium may be set in advance according to the estimated change in temperature, and the jet distances and the jet flow rates may be changed based on the set values.

In addition, a configuration in which the three first cooling headers 211*a* to 211*c* are disposed in the cooling apparatus 2 in a cross section orthogonal to the longitudinal direction of the rail 1 is made in the embodiment described above. However, the present invention is not limited to such an example. Plural first cooling headers may be disposed in a cross section orthogonal to the longitudinal direction of the rail 1, and the number of disposed first cooling headers is not particularly limited.

In addition, air is used as the cooling medium in the embodiment described above. However, the present invention is not limited to such an example. A cooling medium used may be gas, and may be another composition such as $N_2$ or Ar.

Effects of Embodiment (1) An apparatus 2 for cooling a rail 1 according to an aspect of the present invention, configured to jet a cooling medium to the head portion 11 and foot portion 12 of a rail 1 in an austenite temperature range to forcibly cool the rail 1, includes: a first cooling unit 21 including plural first cooling headers 211*a* to 211*c* configured to jet the cooling medium as gas to the head top face and head side of the head portion 11, and first driving units 213*a* to 213*c* configured to move at least one first cooling header 211*a* to 211*c* of the plural first cooling headers 211*a* to 211*c* to change the jet distance of the cooling medium jetted from the first cooling headers 211*a* to 211*c*; and a second cooling unit 22 including a second cooling header 221 configured to jet the cooling medium as gas to the foot portion 12.

In accordance with the configuration of the above (1), a cooling rate can be controlled by adjusting the jet distance of the cooling medium, the amount of the cooling medium used can be therefore reduced, for example, in comparison with a method for controlling a cooling rate only by adjusting the jet flow rate of a cooling medium, and therefore, the rail 1 can be more inexpensively manufactured. In addition, the cooling medium is gas, and therefore, the need for using water is eliminated to enable a facility to be simplified in comparison with, for example, a method in which a cooling medium is switched to perform mist cooling in a manner similar to the manner of PTL 2. Therefore, the rail 1 can be more inexpensively manufactured. In addition, there is no concern that a cold spot is generated even in cooling to low temperature. Therefore, at least 98% or more of the structure of the head portion 11 can be allowed to have a fine pearlite structure, to enable toughness, hardness, and wear resistance to be improved.

(2) The configuration of the above (1) further includes: a control unit 26 configured to control the first driving units 213*a* to 213*c* to adjust the jet distance; and an in-machine thermometer 24 configured to measure the surface temperature of the rail 1, wherein the control unit 26 adjusts the jet distance according to a cooling rate obtained from the result of measurement by the in-machine thermometer 24, and a target cooling rate set in advance.

In accordance with the configuration of the above (2), the rail 1 can be forcibly cooled to achieve an optimal target temperature history according to the actual result of the cooling rate.

(3) In the configuration of above (1) or (2), the first cooling unit further includes a first adjustment unit configured to change the jet flow rate of the cooling medium jetted from the plural first cooling headers.

In the case of a method in which only a jet flow rate is adjusted to control a cooling rate, such as, for example, the method of PTL 1, there has been a limit to an increase in cooling rate only by increasing a jet flow rate. Therefore, it has been difficult to allow an interior to have higher hardness to achieve demanded quality in the case of applying a manufacturing method such as the method of PTL 1 to, for example, a rail used in a curve section for a mine and requiring high wear resistance.

In contrast, the configuration of the above (3) enables a jet distance and a jet flow rate to be adjusted, and therefore enables a cooling rate to further enhanced by shortening the jet distance and increasing the jet flow rate. Therefore, a portion up to the interior of the head portion 11 can be improved in hardness and wear resistance, in comparison with the method of PTL 1.

(4) In any configuration of the above (1) to (3), the second cooling unit further includes a second driving unit configured to move the second cooling header to change the jet distance of the cooling medium jetted from the second cooling header.

The configuration of the above (4) enables a cooling balance between the head portion 11 and the foot portion 12 to be adequate, and therefore enables suppression of upward and downward warpage occurring in a forcible cooling step.

(5) In any configuration of the above (1) to (4), any one or more of the first cooling headers 211*a* to 211*c* and the second cooling header 221 include: a distance meter 27 for measuring a jet distance; and an apparatus configured to control any one or more of the first driving units 213*a* to

213*c* and the second driving unit 223 on the basis of a value measured by the distance meter 27.

The configuration of the above (5) enables a jet distance to be precisely adjusted even in the case of occurrence of warpage in the rail 1, or even in the case of occurrence of warpage in cooling, and enables the rail 1 to be accurately cooled. A driving unit configured to adjust a position on the basis of a value measured by the distance meter 27 may be allowed to be any one or more of the first driving units 213*a* to 213*c* and the second driving unit 223. In consideration of the influence a change in jet distance due to the warpage or bending of the rail 1 on a cooling rate, a driving unit configured to drive a cooling header with the great influence may be controlled based on the value of measurement by the distance meter 27.

(6) A method for manufacturing a rail 1 according to one aspect of the present invention, wherein when a cooling medium is jetted to the head portion and foot portion of a rail in an austenite temperature range to forcibly cool the rail, the cooling medium as gas is jetted from plural first cooling headers to the head top face and head side of the head portion, the cooling medium as gas is jetted from a second cooling header to the foot portion, and at least one first cooling header of the plural first cooling headers is moved to change the jet distance of the cooling medium jetted from the first cooling header.

In accordance with the configuration of the above (6), an effect similar to that of the above (1) can be obtained.

Example 1

Example 1 carried out by the inventors will now be described. Unlike the embodiment described above, first, a rail 1 was manufactured under a condition in which a jet distance was not changed in forcible cooling, and the material of the rail 1 was evaluated, as Conventional Example 1, prior to Example 1.

In Conventional Example 1, first, blooms having the chemical compositions of conditions A to D set forth in Table 1 were cast using a continuous casting method. The balance of the chemical compositions of each of the blooms substantially includes Fe, and specifically includes Fe and unavoidable impurities. A case in which the content of Sb in Table 1 is 0.001% or less indicates that Sb was mixed as an unavoidable impurity. Both the contents of Ti and Al in Table 1 indicate that Ti and Al were mixed as unavoidable impurities.

TABLE 1

| | Chemical Composition (% by mass) | | | | | | | | | |
|---|---|---|---|---|---|---|---|---|---|---|
| Condition | C | Si | Mn | P | S | Cr | Sb | Al | Ti | Others |
| A | 0.83 | 0.52 | 0.51 | 0.015 | 0.008 | 0.192 | 0.0001 | 0.0005 | 0.001 | |
| B | 0.83 | 0.52 | 1.11 | 0.015 | 0.008 | 0.192 | 0.0001 | 0.0005 | 0.001 | |
| C | 1.03 | 0.52 | 1.11 | 0.015 | 0.008 | 0.192 | 0.0001 | 0.0005 | 0.001 | |
| D | 0.84 | 0.87 | 0.55 | 0.018 | 0.004 | 0.784 | 0.0001 | 0.0000 | 0.002 | V: 0.058 |
| E | 0.82 | 0.23 | 1.26 | 0.018 | 0.005 | 0.155 | 0.0360 | 0.0001 | 0.001 | |
| F | 0.83 | 0.66 | 0.26 | 0.015 | 0.005 | 0.896 | 0.1200 | 0.0005 | 0.001 | Cu: 0.11, Ni: 0.12, Mo: 0.11 |
| G | 0.82 | 0.55 | 1.13 | 0.012 | 0.002 | 0.224 | 0.0001 | 0.0000 | 0.000 | Nb: 0.009 |

Then, the cast bloom was reheated to 1100° C. or more in a heating furnace, and then extracted from the heating furnace. Hot rolling in a break down mill, a roughing mill, and a finish rolling mill was performed to make a rail 1 of which the cross-sectional shape was a final shape (141-pound rail according to AREMA (The American Railway Engineering and Maintenance-of-Way Association) standards). For the hot rolling, the rolling was performed so that the rail 1 was in an inverted posture in which a head portion 11 and a foot portion 12 came into contact with a transportation table.

Further, the hot-rolled rail 1 was transported to a cooling apparatus 2 to cool the rail 1 (heat hardening step). In such a case, since the rail 1 was rolled in the inverted posture in the hot rolling, the rail 1 was allowed to be in the erection posture illustrated in FIG. 3, in which the foot portion 12 was in a lower side in the vertical direction and the head portion 11 was in an upper side in the vertical direction, by turning the rail 1 when the rail 1 was carried into the cooling apparatus 2, and the foot portion 12 was restrained by clamps 23*a* and 23*b*. Air was jetted as cooling medium from cooling headers, to perform cooling. Jet distances which were distances between the cooling headers and the rail were allowed to be 20 mm or 50 mm, to be constant, and to be unchanged during cooling. In such a case, relative positions were measured and determined in advance on the basis of the clamps 23*a* and 24*a*, the first cooling headers 211*a* to 211*c*, and the product dimension of the rail, and the jet distances were set by driving the first driving units 213*a* to 213*c*. In a manner similar to the cooling method of PTL 1, a control was further performed in which the jet flow rates of the cooling medium were increased after the decrease of a cooling rate due to generation of heat by transformation in cooling, and the cooling rate was maintained. In such a case, the jet flow rates were adjusted by adjustment units 212*a* to 212*c* so that a constant cooling rate was achieved according to the actual temperature while the temperature of the head portion 11 was continuously measured by an in-machine thermometer 24. The cooling was performed until the surface temperature of the head portion 11 reached 430° C. or less.

After the heat hardening step, the rail 1 was taken from the cooling apparatus 2 to a carrying-out table 4, transported to a cooling bed, and cooled on the cooling bed until the surface temperature of the rail 1 reached 50° C.

Then, straightening was performed using a roller straightening machine, to manufacture the rail 1 as a final product.

Further, in Conventional Example 1, a sample was collected by cold-sawing the manufactured rail 1, and the collected sample was subjected to hardness measurement. In a method of the hardness measurement, a Brinell hardness test was conducted on the surface of the center in the crosswise direction of the head portion 11 of the rail 1, and at depth positions of 5 mm, 10 mm, 15 mm, 20 mm, and 25 mm from the surface of the head portion 11. The condition of compositions, the set value of a jet distance, the actual value of a cooling rate, and the measurement values of Brinell hardnesses in Conventional Example 1 are set forth in Table 2. Each collected sample was etched with nital, and subjected to structure observation with an optical microscope.

TABLE 2

| Condition | Composition | Jet Distance mm | Cooling Rate ° C./sec | Brinell Hardness HB Surface | 5 mm | 10 mm | 15 mm | 20 mm | 25 mm |
|---|---|---|---|---|---|---|---|---|---|
| Conventional Example 1-1 | A | 20 | 2 | 369 | 367 | 362 | 357 | 352 | 344 |
| Conventional Example 1-2 | A | 50 | 2 | 369 | 364 | 358 | 354 | 350 | 344 |
| Conventional Example 1-3 | A | 20 | 4 | 380 | 376 | 370 | 367 | 362 | 354 |
| Conventional Example 1-4 | A | 50 | 4 | 378 | 377 | 371 | 365 | 361 | 355 |
| Conventional Example 1-5 | B | 20 | 2 | 373 | 369 | 367 | 358 | 356 | 351 |
| Conventional Example 1-6 | C | 20 | 2 | 379 | 373 | 369 | 364 | 362 | 355 |
| Conventional Example 1-7 | D | 20 | 3 | 449 | 434 | 422 | 403 | 392 | 376 |

Then, the inventors attempted adjusting a cooling rate during forcible cooling by controlling the jet distance of a cooling medium rather than by controlling the jet flow rate of the cooling medium, in Example 1.

In Example 1, first, blooms having the chemical compositions of the conditions A to D set forth in Table 1 were cast using a continuous casting method. The balance of the chemical compositions of each of the blooms substantially includes Fe, and specifically includes Fe and unavoidable impurities.

Then, in a manner similar to the manner of Conventional Example 1, the cast bloom was reheated to 1100° C. or more in a heating furnace, and then hot-rolled in an inverted posture.

Further, a hot-rolled rail 1 was transported to a cooling apparatus 2 to cool the rail 1 (heat hardening step). In such a case, the foot portion 12 of the rail 1 was restrained by clamps 23*a* and 23*b* in a state in which the rail 1 was allowed to be in an erection posture by turning the rail 1 when the rail 1 was carried into the cooling apparatus 2, in a manner similar to the manner of Conventional Example 1. Air was jetted as cooling medium from cooling headers, to perform cooling. Jet distances which were distances between the cooling headers and the rail in the early period of forcible cooling before starting of phase transformation were allowed to be 20 mm or 50 mm and to be constant. In such a case, relative positions were measured and determined in advance on the basis of the clamps 23*a* and 24*a*, first cooling headers 211*a* to 211*c*, and the product dimension of the rail, and the jet distances were set by driving the first driving units 213*a* to 213*c*. A control was further performed in which each of the jet distances of the first cooling headers 211*a* to 211*c* was changed from 20 mm to 15 mm or from 50 mm to 45 mm after the decrease of a cooling rate due to generation of heat by transformation in cooling, and the cooling rate was maintained. The cooling was performed until the surface temperature of a head portion 11 reached 430° C. or less.

After the heat hardening step, the rail 1 was cooled on a cooling bed until the surface temperature of the rail 1 reached 50° C., in a manner similar to the manner of Conventional Example 1. Straightening was performed using a roller straightening machine, to manufacture the rail 1 as a final product.

Further, in a manner similar to the manner of Conventional Example 1, a sample was collected by cold-sawing the manufactured rail 1, and the collected sample was subjected to hardness measurement. The condition of compositions, the set value of a jet distance, the actual value of a cooling rate, and the measurement values of Brinell hardnesses in Example 1 are set forth in Table 3. Each collected sample was subjected to structure observation with an optical microscope in a manner similar to the manner of Conventional Example 1.

TABLE 3

| Condition | Composition | Jet Distance Early Period mm | Jet Distance Later Period mm | Cooling Rate ° C./sec | Brinell Hardness HB Surface | 5 mm | 10 mm | 15 mm | 20 mm | 25 mm |
|---|---|---|---|---|---|---|---|---|---|---|
| Example 1-1 | A | 20 | 15 | 2 | 368 | 365 | 362 | 357 | 348 | 344 |
| Example 1-2 | A | 50 | 45 | 2 | 371 | 364 | 359 | 357 | 351 | 346 |
| Example 1-3 | A | 20 | 15 | 4 | 381 | 373 | 368 | 367 | 359 | 353 |
| Example 1-4 | A | 50 | 45 | 4 | 378 | 373 | 371 | 365 | 359 | 353 |
| Example 1-5 | B | 20 | 15 | 3 | 375 | 371 | 364 | 360 | 357 | 349 |
| Example 1-6 | C | 20 | 15 | 3 | 378 | 374 | 368 | 367 | 359 | 357 |
| Example 1-7 | D | 20 | 15 | 3 | 428 | 422 | 410 | 399 | 390 | 380 |

TABLE 3-continued

| Condition | Composition | Jet Distance Early Period mm | Jet Distance Later Period mm | Cooling Rate ° C./sec | Brinell Hardness HB Surface | 5 mm | 10 mm | 15 mm | 20 mm | 25 mm |
|---|---|---|---|---|---|---|---|---|---|---|
| Example 1-8 | A | 20 | 15 | 2 | 373 | 369 | 361 | 353 | 351 | 346 |
| Example 1-9 | A | 20 | 15 | 2 | 372 | 367 | 360 | 353 | 348 | 343 |

As set forth in Table 3, the rail 1 was manufactured under the seven conditions of Examples 1-1 to 1-7, of which the compositions, jet distances, and cooling rates were different, and the Brinell hardness of the head portion 11 was measured, in Example 1. In Examples 1-1 to 1-7, the three first cooling headers 211*a* to 211*c* are moved without moving a second cooling header 221 during forcible cooling, and the forcible cooling was performed. In Example 1-8, only the first cooling header 211*a* was moved without moving the second cooling header 221 and the two first cooling headers 211*b* and 211*c*, and forcible cooling was performed. In Example 1-9, all the cooling headers of the three first cooling headers 211*a* to 211*c* and the second cooling header 221 were moved, and forcible cooling was performed. In such a case, relative positions were measured and determined in advance on the basis of the clamps 23*a* and 24*a*, first cooling headers 211*a* to 211*c*, and the product dimension of the rail, and the jet distances were changed by driving the first driving units 213*a* to 213*c*. In Examples 1-1 to 1-7, the forcible cooling was performed at the same cooling rates as those in Conventional Examples 1-1 to 1-7, respectively. The cooling rates were adjusted based on the jet distances of the cooling medium in Examples 1-1 to 1-7 whereas the cooling rates were adjusted based on the jet flow rates of the cooling medium in Conventional Examples 1-1 to 1-7.

As set forth in Table 2 and Table 3, the hardnesses in Examples 1-1 to 1-7 were able to be confirmed to be equivalent to those in Conventional Examples 1-1 to 1-7, respectively, in which the conditions of the cooling rates at the surface and depths up to 25 mm of the head portion 11 were the same as those in Examples 1-1 to 1-7. In Conventional Examples 1-1 to 1-7, the jet flow rates of the cooling medium were increased after heat generation due to phase transformation, and therefore, the used amounts of cooling medium used in the forcible cooling were increased. In contrast, in Examples 1-1 to 1-7, the cooling rates were able to be adjusted merely by changing the jet distances of the cooling medium even without increasing the jet flow rates of the cooling medium, and therefore, the used amounts of cooling medium used in the forcible cooling can be reduced to be able to reduce energy costs in comparison with Conventional Examples 1-1 to 1-7.

In Example 1-8 in which only the first cooling header 211*a* configured to jet the cooling medium to the head top face of the head portion 11 during the forcible cooling was moved, the hardnesses at the surface and a depth of 5 mm were able to be confirmed to be increased by around HB 5 in comparison with Example 1-1 in which the manufacturing was performed with the same composition and at the same cooling rate.

In addition, sagging of 500 mm per 100 m was confirmed to occur in the manufactured rail 1 in Example 1-1. In contrast, in Example 1-9 in which the second cooling header 221 was moved during the forcible cooling to adjust the jet distance to increase the cooling amount of the foot portion 12, a cooling balance between the head portion 11 and the foot portion 12 was allowed to be adequate, warpage was decreased to 1/10 in comparison with Example 1-1, and sagging of 50 mm per 100 m occurred.

In addition, when the structure of a cross section of the sample in each of Conventional Examples 1-1 to 1-7 and Examples 1-1 to 1-9 was observed, the entire rail 1 including the surface of the head portion 11 was confirmed to have a pearlite structure, and neither a martensite structure nor a bainite structure was observed.

Example 2

Example 2 carried out by the present inventors will now be described. In Example 2, forcible cooling was performed while changing the cooling rates and cooling flow rates of cooling medium in a manner similar to the manner of the embodiment described above, and the material of Example 2 was evaluated.

First, a method in which cooling medium were changed from air to mist during forcible cooling, and the cooling was performed in a manner similar to the manner of PTL 2, and a method in which cooling flow rates were changed by changing the jet pressures of the cooling medium during the forcible cooling, and the cooling was performed were performed without changing jet distances, as Conventional Example 2, prior to Example 2. In Conventional Example 2, first, blooms having the chemical compositions of the conditions D and F set forth in Table 1 were cast using a continuous casting method. The balance of the chemical compositions of each of the blooms substantially includes Fe, and specifically includes Fe and unavoidable impurities.

Then, in a manner similar to the manner of Conventional Example 1, the cast bloom was reheated to 1100° C. or more in a heating furnace, and then hot-rolled in an inverted posture.

Further, a hot-rolled rail 1 was transported to a cooling apparatus 2 to cool the rail 1 (heat hardening step). In such a case, the foot portion 12 of the rail 1 was restrained by clamps 23*a* and 23*b* in a state in which the rail 1 was allowed to be in an erection posture by turning the rail 1 when the rail 1 was carried into the cooling apparatus 2, in a manner similar to the manner of Conventional Example 1. Air or mist was jetted as cooling medium from cooling headers, to perform cooling. Jet distances which were distances between the cooling headers and the rail were allowed to be 20 mm or 30 mm, to be constant, and to be unchanged during cooling. In addition, the heat hardening step was divided into two stages of an initial cooling step and a final cooling step in which cooling conditions were different, and cooling was performed until the surface temperature of a head portion 11 reached 430° C. or less, in Conventional Example 2.

After the heat hardening step, the rail 1 was cooled on a cooling bed until the surface temperature of the rail 1 reached 50° C., in a manner similar to the manner of Conventional Example 1. Straightening was performed using a roller straightening machine, to manufacture the rail 1 as a final product.

Further, in a manner similar to the manner of Conventional Example 1, a sample was collected by cold-sawing the manufactured rail 1, and the collected sample was subjected to hardness measurement. The condition of compositions, cooling conditions (cooling time (only in an initial cooling step), the set value of a jet distance, and the actual value of a cooling rate) in each cooling step, and the measurement values of Brinell hardnesses in Conventional Example 2 and Example 2 described later are set forth in Table 4. Each collected sample was subjected to structure observation with an optical microscope in a manner similar to the manner of Conventional Example 1.

TABLE 4

| | | Initial Cooling Step | | | Intermediate Cooling Step | | |
|---|---|---|---|---|---|---|---|
| Condition | Composition | Time sec | Jet Distance mm | Cooling Rate ° C./sec | Time sec | Jet Distance mm | Cooling Rate ° C./sec |
| Conventional Example 2-1 | D | 20 | 20 | 3 | | | |
| Conventional Example 2-2 | F | 30 | 30 | 1 | | | |
| Example 2-1 | D | 20 | 20 | 3 | | | |
| Example 2-2 | D | 30 | 10 | 5 | 20 | 30 | 0 |
| Example 2-3 | F | 30 | 30 | 1 | | | |
| Example 2-4 | G | 40 | 20 | 4 | | | |
| Example 2-5 | G | 40 | 20 | 4 | 10 | 10 | 6 |
| Example 2-6 | A | 30 | 20 | 2 | | | |
| Example 2-7 | B | 30 | 20 | 3 | | | |
| Example 2-8 | C | 30 | 20 | 3 | | | |
| Example 2-9 | E | 30 | 20 | 3 | | | |

| | Final Cooling Step | | Brinell Hardness HB | | | | | |
|---|---|---|---|---|---|---|---|---|
| Condition | Jet Distance mm | Cooling Rate ° C./sec | Surface | 5 mm | 10 mm | 15 mm | 20 mm | 25 mm |
| Conventional Example 2-1 | 20 | 5 | 548 | 440 | 431 | 419 | 409 | 405 |
| Conventional Example 2-2 | 30 | 12 (target: 15) | 395 | 392 | 391 | 386 | 380 | 376 |
| Example 2-1 | 10 | 5 | 432 | 422 | 414 | 412 | 403 | 400 |
| Example 2-2 | 10 | 5 | 452 | 442 | 428 | 421 | 408 | 406 |
| Example 2-3 | 5 | 15 | 397 | 390 | 406 | 401 | 395 | 391 |
| Example 2-4 | 10 | 5 | 388 | 385 | 397 | 388 | 385 | 382 |
| Example 2-5 | 200 | 1 | 391 | 385 | 396 | 388 | 383 | 384 |
| Example 2-6 | 10 | 5 | 368 | 364 | 374 | 368 | 365 | 362 |
| Example 2-7 | 10 | 5 | 376 | 369 | 380 | 376 | 372 | 363 |
| Example 2-8 | 10 | 5 | 382 | 375 | 385 | 381 | 377 | 370 |
| Example 2-9 | 10 | 5 | 368 | 365 | 373 | 372 | 365 | 360 |

As set forth in Table 4, a rail 1 was manufactured under two conditions of Conventional Examples 2-1 and 2-2 of which the compositions and cooling conditions were different, in Conventional Example 2. In the case of Conventional Example 2-1, cooling was performed using air as a cooling medium in a first cooling step after start of forcible cooling, and after a lapse of 20 seconds, the cooling medium was changed from the air to mist to perform cooling for 150 seconds in a final cooling step. In the case of Conventional Example 2-2, cooling was performed using air as a cooling medium in both an initial cooling step and a final cooling step after start of forcible cooling. Further, in Conventional Example 2-2, the forcible cooling was performed in which the jet pressure of the cooling medium was set at 5 kPa in a period from the start of the forcible cooling to a lapse of 30 seconds in the initial cooling step, and the jet pressure of the cooling medium was then set at 100 kPa in a period to a lapse of 150 seconds in the second cooling step.

In Conventional Example 2-2, a jet flow rate was also increased with increasing the jet pressure in the final cooling step. In Conventional Example 2-2, the target cooling rate of the final cooling step was set at 15° C./sec; however, although the cooling medium was jetted at a high pressure (high flow rate) of 100 kPa, an actual cooling rate was 12° C./sec and was confirmed to fail to reach the target cooling rate.

When the structure of the sample of Conventional Example 2-1 was observed, an entire rail 1 including a surface was confirmed to have a pearlite structure. In contrast, in Conventional Example 2-2, a structure deteriorating toughness and wear resistance, such as a martensite structure or a bainite structure, was observed in a part of a surface. This is considered to be because a position repeatedly hit by a large number of water droplets was quenched by mist cooling, to generate a region referred to as a cold spot.

Then, the present inventors manufactured a rail 1 with changing the jet distance and jet flow rate of a cooling medium in a manner similar to the manner the embodiment described above, in Example 2.

In Example 2, first, blooms having the chemical compositions of the conditions A to G set forth in Table 1 were cast using a continuous casting method. The balance of the chemical compositions of each of the blooms substantially includes Fe, and specifically includes Fe and unavoidable impurities.

Then, in a manner similar to the manner of Conventional Example 1, the cast bloom was reheated to 1100° C. or more in a heating furnace, and then hot-rolled in an inverted posture.

Further, a hot-rolled rail 1 was transported to a cooling apparatus 2 to cool the rail 1 (heat hardening step). In such a case, the foot portion 12 of the rail 1 was restrained by clamps 23*a* and 23*b* in a state in which the rail 1 was allowed to be in an erection posture by turning the rail 1 when the rail 1 was carried into the cooling apparatus 2, in a manner similar to the manner of Conventional Example 1. Air was jetted as cooling medium from cooling headers, to perform cooling.

In Example 2, the heat hardening step was divided into two stages of an initial cooling step and a final cooling step in which jet distances and cooling rates were different, or three stages of an initial cooling step, an intermediate cooling step, and a final cooling step, and cooling was finally performed until the surface temperature of a head portion 11 reached 430° C. or less. In such a case, the jet flow rates of cooling medium jetted from first cooling headers 211*a* to 211*c* were controlled so that a cooling rate obtained from the result of measurement by an in-machine thermometer 24 was a target cooling rate. The cooling rate in such a case was a value calculated from surface temperatures at the times of the start and end of each cooling step, and time for which each cooling step was performed (average cooling rate in each cooling step), and may also include an increase in temperature, caused by generation of heat by transformation occurring in each cooling step.

After the heat hardening step, the rail 1 was cooled on a cooling bed until the surface temperature of the rail 1 reached 50° C., in a Manner similar to the manner of Conventional Example 1. Straightening was performed using a roller straightening machine, to manufacture the rail 1 as a final product.

Further, in a manner similar to the manner of Conventional Example 1, a sample was collected by cold-sawing the manufactured rail 1, and the collected sample was subjected to hardness measurement. Each collected sample was subjected to structure observation with an optical microscope in a manner similar to the manner of Conventional Example 1.

As set forth in Table 4, the rail 1 was manufactured under the nine conditions of Examples 2-1 to 2-9, of which the compositions and cooling conditions were different, in Example 2. As set forth in Table 4, the heat hardening step was divided into two stages of an initial cooling step and a final cooling step, and performed under the conditions of Examples 2-1, 2-3, 2-4, and 2-6 to 2-9. The heat hardening step was divided into three stages of an initial cooling step, an intermediate cooling step, and a final cooling step, and performed under the conditions of Examples 2-2 and 2-5.

As a result of structure observation in Example 2, the entire structure of the head portion 11 including the surface was confirmed to include a pearlite structure under all the conditions of Examples 2-1 to 2-9. In other words, the entire structure of the head portion 11 including the surface was able to be also confirmed to include a pearlite structure, and to include neither a martensite structure nor a bainite structure, in Conventional Example 2-2 and Example 2-3 in which the cooling conditions in the initial cooling step and the final cooling step were identical. In Example 2-3, hardnesses at positions deeper than 5 mm, excluding the surface of the head portion 11, were able to be confirmed to be almost equivalent to those in Conventional Example 2-1. In contrast, in Example 2-2 in which the jet flow rate (jet pressure) of the cooling medium was changed without changing the jet distance to increase the cooling rate in the later period of cooling in the heat hardening step, decreases in hardness particularly at positions deeper than 10 mm were confirmed in comparison with Example 2-3 with the similar cooling condition.

In addition, the rails 1 manufactured under the conditions of Examples 2-1 and 2-2 were confirmed to achieve conditions of a surface hardness of HB 420 or more and a hardness of HB 390 or more at a depth of 25 mm, which were conditions applicable to a curve section.

Example 3

Example 3 carried out by the present inventors will now be described. In Example 3, forcible cooling was performed while changing the cooling rates of cooling medium in a manner similar to the manner of the embodiment described above, and the influence of a method of determining a jet distance on a material was evaluated.

In Example 3, first, a bloom having the chemical composition of the condition D set forth in Table 1 was cast using a continuous casting method. The balance of the chemical compositions of the bloom substantially includes Fe, and specifically includes Fe and unavoidable impurities.

Then, the cast bloom was reheated to 1100° C. or more in a heating furnace, and then hot-rolled in an inverted posture.

Further, a hot-rolled rail 1 was transported to a cooling apparatus 2 to cool the rail 1 (heat hardening step). In such a case, the foot portion 12 of the rail 1 was restrained by clamps 23*a* and 23*b* in a state in which the rail 1 was allowed to be in an erection posture by turning the rail 1 when the rail 1 was carried into the cooling apparatus 2. The conditions of the heat hardening step were set at those in Example 2-1 set forth in Table 4; and air was jetted as cooling medium from cooling headers, to perform cooling.

The heat hardening step was divided into two stages of an initial cooling step and a final cooling step in which jet distances and cooling rates were different, and cooling was finally performed until the surface temperature of a head portion 11 reached 430° C. or less. In such a case, the jet flow rates of cooling medium jetted from first cooling headers 211*a* to 211*c* were controlled so that a cooling rate obtained from the result of measurement by an in-machine thermometer 24 was a target cooling rate. The cooling rate in such a case was a value calculated from surface temperatures at the times of the start and end of each cooling step, and time for which each cooling step was performed (average cooling rate in each cooling step), and may also include an increase in temperature, caused by generation of heat by transformation occurring in each cooling step.

Cooling conditions (cooling time (only in an initial cooling step), the set value of a jet distance, and the actual value of a cooling rate) and a distance controlling method in each condition are set forth in Table 5. In a condition referred to as "relative position", relative positions were measured and determined in advance on the basis of the clamps 23*a* and 23*b*, the first cooling headers 211*a* to 211*c*, and the product dimension of the rail, and the jet distances were changed by driving the first driving units 213*a* to 213*c*. In a condition referred to as "laser displacement meter" or "vortex flow type displacement meter", a laser displacement meter or a vortex flow type displacement meter was placed at the position of a distance meter 27 illustrated in FIG. 1 and FIG. 2 (a center in the crosswise direction of each header, a longitudinal end), a distance was measured by the distance meter 27 as needed, and in the case of the presence of an error, first driving units 213*a* to 213*c* were driven so that a predetermined jet distance was automatically achieved, to correct the error.

ment values of the relative positions of the cooling headers, and s difference caused by the machine difference between the driving units occur.

TABLE 5

| | | | | | | | | Brinell Hardness HB | | |
|---|---|---|---|---|---|---|---|---|---|---|
| | | Distance | Initial Cooling Step | | | Final Cooling Step | | Surface | | |
| Condition | Composition | Controlling Method | Time sec | Jet Distance mm | Cooling Rate ° C./sec | Jet Distance mm | Cooling Rate ° C./sec | Average | Standard Deviation | 5 mm Average |
| Example 3-1 | D | Relative position | 20 | 20 | 3 | 10 | 5 | 432 | 25 | 422 |
| Example 3-2 | | Laser displacement meter | | | | | | 434 | 6 | 423 |
| Example 3-3 | | Vortex flow type displacement meter | | | | | | 434 | 9 | 422 |

| | Brinell Hardness HB | | | | | | | | |
|---|---|---|---|---|---|---|---|---|---|
| | 5 mm | | 10 mm | | 15 mm | | 20 mm | | 25 mm | |
| Condition | Standard Deviation | Average | Standard Deviation | Average | Standard Deviation | Average | Standard Deviation | Average | Standard Deviation |
| Example 3-1 | 19 | 414 | 12 | 412 | 9 | 403 | 7 | 400 | 5 |
| Example 3-2 | 5 | 415 | 5 | 413 | 5 | 402 | 4 | 402 | 3 |
| Example 3-3 | 5 | 414 | 6 | 410 | 5 | 402 | 3 | 399 | 4 |

A distance between a second cooling header 221 and a rail 1, i.e., the jet distance of the second cooling header 221 was set at 30 mm, and cooling was performed without changing the jet distance. The target cooling rate of the foot portion 12 of the rail 1, cooled by the second cooling header 221, was set at 1.5° C./sec.

After the heat hardening step, the rail 1 was taken from the cooling apparatus 2 to a carrying-out table 4, transported to a cooling bed, and cooled on the cooling bed until the surface temperature of the rail 1 reached 50° C.

Then, straightening was performed using a roller straightening machine, to manufacture the rail 1 as a final product. In such a case, the warpage in the upward and downward direction of the final product was sagging in amounts of around 25 m in the longitudinal direction and 50 mm in the upward and downward direction.

A sample was collected by cold-sawing the manufactured rail 1, and the collected sample was subjected to hardness measurement. In a method of the hardness measurement, a Brinell hardness test was conducted on the surface of the center in the crosswise direction of the head portion 11 of the rail 1, and at depth positions of 5 mm, 10 mm, 15 mm, 20 mm, and 25 mm from the surface of the head portion 11.

As set forth in Table 5, each condition difference between the average values of Brinell hardnesses was as low as HB 3 or less, while the value of the standard deviation of the hardnesses, determined from 21 samples, under the condition of Example 3-1 in which the jet distance was set at a relative position determined from the clamps 23*a* and 23*b*, the first cooling headers 211*a* to 211*c*, and the product dimension of the rail, was higher than those of Examples 3-2 and 3-3 under the conditions in which the jet distances were automatically controlled. The reason why the standard deviation of Example 3-1 was high was considered to be that the plural cooling headers were arranged in series in the longitudinal direction, and the dispersion in the measure- Thus, it was confirmed that an apparatus capable of online measuring a jet distance was preferred for controlling a jet distance, and it was preferable to place a laser displacement meter, a vortex flow type displacement meter, or the like.

In Example 3, the amount of the warpage of the product was large, and therefore, a heat hardening step was also performed under a condition in which the cooling rate and jet distance of the second cooling header 221 was changed by the driving of a second driving unit 223. In such a case, cooling was performed by controlling the jet distance and cooling rate of the second cooling header 221 in the initial cooling step to 30 mm and 1.5° C./sec, respectively, and by setting the jet distance and cooling rate of the second cooling header 221 at 20 mm and 2.5° C./sec, respectively, at the timing of starting the final cooling step. As a result, the warpage was hogging in a warpage amount of 10 mm per 25 m of the rail, and success in decreasing the amount of the warpage and controlling the amount the warpage was achieved.

REFERENCE SIGNS LIST

1 Rail
11 Head portion
12 Foot portion
13 Web portion
2 Cooling apparatus
21 First cooling unit
211*a* to 211*c* First cooling header
212*a* to 212*c* First adjustment unit
213*a* to 213*c* First driving unit
22 Second cooling unit
221 Second cooling header
222 Second adjustment unit
223 Second driving unit
23*a*, 23*b* Clamp
24 In-machine thermometer

25 Transportation unit
26 Control unit
227 Distance meter
3 Carrying-in table
4 Carrying-out table
5 Output side thermometer

The invention claimed is:

1. An apparatus for cooling a rail, configured to jet a cooling medium to a head portion and a foot portion of a rail in an austenite temperature range to forcibly cool the rail, the apparatus comprising:

a first cooling unit comprising a plurality of first cooling headers configured to jet the cooling medium as gas to a head top face and a head side of the head portion, and a first driving unit configured to move at least one first cooling header of the plurality of first cooling headers during forcible cooling to change a jet distance of the cooling medium jetted from the first cooling header;

a second cooling unit comprising a second cooling header configured to jet the cooling medium to the foot portions;

a control unit configured to control the first driving unit to adjust the jet distance; and an in-machine thermometer configured to measure a surface temperature of the rail, wherein the control unit adjusts the jet distance according to a cooling rate obtained from a result of measurement by the in-machine thermometer, and a target cooling rate set in advance.

2. The apparatus for cooling a rail according to claim 1, wherein the first cooling unit further comprises a first adjustment unit configured to change a jet flow rate of the cooling medium jetted from the plurality of first cooling headers.

3. The apparatus for cooling a rail according to claim 1, wherein the second cooling unit further comprises a second driving unit configured to move the second cooling header to change a jet distance of the cooling medium jetted from the second cooling header.

4. The apparatus for cooling a rail according to claim 1, wherein any one or more of the first cooling header and the second cooling header comprise:

a distance meter for measuring a jet distance; and an apparatus configured to control any one or more of the first driving unit and the second driving unit based on a value measured by the distance meter.

5. A method for manufacturing a rail, wherein when a cooling medium is jetted to a head portion and foot portion of a rail in an austenite temperature range to forcibly cool the rail, the cooling medium as gas is jetted from a plurality of first cooling headers to a head top face and a head side of the head portion, the cooling medium is jetted from a second cooling header to the foot portion, at least one first cooling header of the plurality of first cooling headers is moved during forcible cooling to change a jet distance of the cooling medium jetted from the first cooling header;

a control unit configured to control the first driving unit to adjust the jet distance; and an in-machine thermometer configured to measure a surface temperature of the rail, wherein the control unit adjusts the jet distance according to a cooling rate obtained from a result of measurement by the in-machine thermometer, and a target cooling rate set in advance.

6. The apparatus for cooling a rail according to claim 2, wherein the second cooling unit further comprises a second driving unit configured to move the second cooling header to change a jet distance of the cooling medium jetted from the second cooling header.

7. The apparatus for cooling a rail according to claim 3, wherein any one or more of the first cooling header and the second cooling header comprise:

a distance meter for measuring a jet distance; and an apparatus configured to control any one or more of the first driving unit and the second driving unit based on a value measured by the distance meter.

8. The apparatus for cooling a rail according to claim 2, wherein any one or more of the first cooling header and the second cooling header comprise:

a distance meter for measuring a jet distance; and an apparatus configured to control any one or more of the first driving unit and the second driving unit based on a value measured by the distance meter.

* * * * *